US010197047B2

(12) United States Patent
Schroeder et al.

(10) Patent No.: US 10,197,047 B2
(45) Date of Patent: Feb. 5, 2019

(54) HYDRAULIC PROPORTIONING SYSTEM WITH FLOW DIVIDER

(71) Applicant: Graco Minnesota Inc., Minneapolis, MN (US)

(72) Inventors: James C. Schroeder, Ramsey, MN (US); Dennis R. Dingmann, Blaine, MN (US)

(73) Assignee: Graco Minnesota, Inc., Minneapolis, MN (US)

( * ) Notice: Subject to any disclaimer, the term of this patent is extended or adjusted under 35 U.S.C. 154(b) by 542 days.

(21) Appl. No.: 14/736,807

(22) Filed: Jun. 11, 2015

(65) Prior Publication Data

US 2015/0361968 A1 Dec. 17, 2015

Related U.S. Application Data

(60) Provisional application No. 62/010,711, filed on Jun. 11, 2014.

(51) Int. Cl.

| | |
|---|---|
| ***F04B 13/00*** | (2006.01) |
| ***F04B 13/02*** | (2006.01) |
| ***F04B 17/06*** | (2006.01) |
| ***F04B 23/06*** | (2006.01) |
| ***F04B 23/02*** | (2006.01) |
| ***F04B 15/02*** | (2006.01) |
| ***E01C 23/22*** | (2006.01) |

(52) U.S. Cl.

CPC ..... *F04B 13/02* (2013.01); *E01C 23/22* (2013.01); *F04B 15/02* (2013.01); *F04B 17/06* (2013.01); *F04B 23/02* (2013.01); *F04B 23/06* (2013.01)

(58) Field of Classification Search

CPC ..... E01C 23/22; F04B 13/02; F04B 15/02; F04B 17/06; F04B 23/02; F04B 23/06

USPC ..... 366/190

See application file for complete search history.

(56) References Cited

U.S. PATENT DOCUMENTS

| | | | | | |
|---|---|---|---|---|---|
| 4,328,824 | A * | 5/1982 | Kiernan | F02C 7/228 | 137/99 |
| 4,490,096 | A * | 12/1984 | Box | F04B 9/1178 | 417/342 |
| 4,917,580 | A * | 4/1990 | Schnetzer | B05B 12/00 | 417/345 |
| 5,114,319 | A * | 5/1992 | Faber | F04B 7/0023 | 417/342 |
| 5,306,124 | A * | 4/1994 | Back | F04D 7/04 | 417/406 |
| 5,647,211 | A * | 7/1997 | Harber | E02F 9/2253 | 60/484 |
| 2012/0282121 | A1* | 11/2012 | Kieffer | B01F 15/042 | 417/410.1 |

(Continued)

*Primary Examiner* — Anshu Bhatia

(74) *Attorney, Agent, or Firm* — Kinney & Lange, P.A.

(57) ABSTRACT

A hydraulic proportioning system has a flow divider providing hydraulic fluid to drive two hydraulic pumps. The flow divider provides set amounts of hydraulic oil to each of two pumps, and the pumps each provide one material of the plural component material downstream to a mixing manifold. The two materials are mixed at the mixing manifold before application. The flow divider drives each pump at a set speed depending on the volume of hydraulic oil provided to each pump. The flow divider thus determines the ratio of the first material to the second material provided to the mixing manifold by the pumps.

20 Claims, 5 Drawing Sheets

(56) References Cited

U.S. PATENT DOCUMENTS

2013/0087411 A1* 4/2013 Shade ..... B60K 7/0015
182/63.1

* cited by examiner

HYDRAULIC PROPORTIONING SYSTEM WITH FLOW DIVIDER

CROSS-REFERENCE TO RELATED APPLICATION(S)

This application claims priority to U.S. Provisional Application No. 62/010,711 filed on Jun. 11, 2014, and entitled "Hydraulic Proportioning System with Hydraulic Divider," by inventors Dennis Dingmann and James Schroeder, the disclosure of which is incorporated by reference in its entirety.

BACKGROUND

This disclosure relates to generally to pavement marking systems, and more particularly to a hydraulic proportioning system for a plural component pavement marker.

Plural component sprayers are utilized to provide precise, fixed flow ratios for plural component liquids such as durable traffic markings, epoxies, polyuria, methyl methacrylate, paints, foams, and adhesives. The component materials of the plural component sprayer are proportioned according to a set ratio, to ensure that the plural component material has desirable properties. Electric and mechanical proportioning systems are typically used for proportioning plural component liquids. Hydraulic proportioning systems are utilized in some instances, but hydraulic proportioning systems are typically large and complex. In addition, hydraulic proportioning systems may require the user to substitute pumps of various sizes and displacements to achieve different component ratios.

SUMMARY

In one embodiment of the present invention, a hydraulic proportioning system includes a flow divider, the flow divider dividing a flow of hydraulic fluid into a first portion and a second portion, first and second motors connected to the flow divider by first and second supply lines, a first pump, and a second pump. The first hydraulic line supplying the first portion to the first motor, the first portion driving the first motor. The second hydraulic line supplying the second portion to the second motor, the second portion driving the second motor. The first pump is driven by the first motor, and the first pump drives a first component material downstream. The second pump is driven by the second motor, and the second pump drives a second component material downstream. The first component material and the second component material are combined at a location downstream of the first pump and the second pump to form a plural component material.

In another embodiment of the present invention, a mobile applicator includes a frame, a plurality of wheels rotatably connected to the frame, a first container mounted to the frame, a second container mounted to the frame, a mixing manifold, and a plural component proportioning system. The mixing manifold is positioned to receive a first component material from the first container and a second component material from the second container. The plural component proportioning system includes a flow divider, the flow divider dividing a flow of hydraulic fluid into a first portion and a second portion, a first hydraulic motor connected to the flow divider by a first hydraulic line, a second hydraulic motor connected to the flow divider by a second hydraulic line, a first pump driven by the first hydraulic motor, and a second pump driven by the second hydraulic motor. The first hydraulic line supplying the first portion to the first motor, the first portion driving the first motor. The second hydraulic line supplying the second portion to the second motor, the second portion driving the second motor. The first pump drives the first component material from the first container to the mixing manifold, and the second pump drives the second component material from the second container to the mixing manifold.

In yet another embodiment of the present invention, a method for proportioning plural component materials includes dividing a flow of hydraulic fluid with a flow divider into a first portion and a second portion. A first hydraulic pump is driven at a first speed with the first portion, the first hydraulic pump pumping a first component material. A second hydraulic pump is driven at a second speed with the second portion, the second hydraulic pump pumping a second component material. The first component material is mixed with the second component material in a mixing manifold. A ratio of the first material to the second material is controlled at the mixing manifold as a result of the division of the flow of hydraulic fluid by the flow divider.

DETAILED DESCRIPTION

Figure 1:
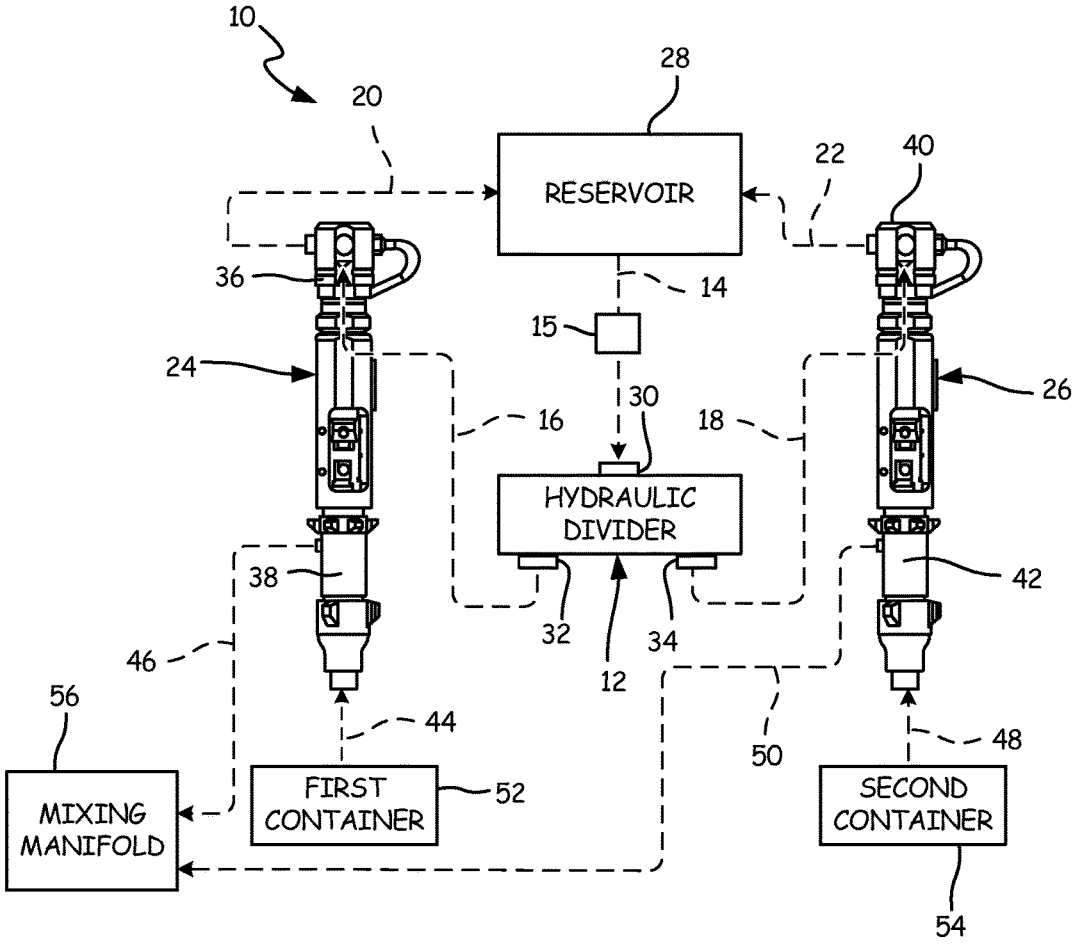
FIG. 1 is a schematic view of a hydraulic proportioning system.

FIG. 1 shows a schematic view of hydraulic proportioning system 10. Hydraulic proportioning system 10 includes flow divider 12, inlet line 14, hydraulic drive 15, first supply line 16, second supply line 18, first return line 20, second return line 22, first drive unit 24, second drive unit 26, and reservoir 28. Flow divider 12 includes inlet 30, first outlet 32, and second outlet 34. First drive unit 24 includes first motor 36 and first pump 38. Second drive unit 26 includes second motor 40 and second pump 42. FIG. 1 further illustrates first component feed line 44, first component distribution line 46, second component feed line 48, second component distribution line 50, first container 52, second container 54, and mixing manifold 56.

Inlet line 14 is connected to flow divider 12 at inlet 30. Inlet line 14 is also connected to reservoir 28 and provides a fluid path for hydraulic fluid to flow from reservoir 28 to flow divider 12. A first end of first supply line 16 is connected to first outlet 32 and a second end of first supply line 16 is connected to first motor 36. A first end of second supply line 18 is connected to second outlet 34 and a second end of second supply line 18 is connected to second motor 40. Hydraulic drive 15 is disposed between flow divider 12 and reservoir 28.

First motor 36 is mounted to and drives first pump 38. Second motor 40 is mounted to and drives second pump 42. First component feed line 44 is connected to an inlet of first pump 38 and to first container 52. A first end of first component distribution line 46 is connected to an outlet of first pump 38 and a second end of first component distribution line 46 is connected to mixing manifold 56 located downstream of first pump 38. Second component feed line 48 is connected to an inlet of second pump 42 and a second end of second component feed line 48 is also connected to second container 54. A first end of second component distribution line 50 is connected to an outlet of second pump 42 and a second end of second component distribution line 50 is connected to mixing manifold 56.

Hydraulic fluid is provided to flow divider 12 from reservoir 28 through inlet line 14. Flow divider 12 splits the hydraulic fluid into a first portion and a second portion. The first portion is provided downstream through first supply line 16 to first motor 36. The first portion powers first motor 36 to drive first pump 38. The first portion exits first motor 36 through the outlet of first motor 36 and is returned to reservoir 28 through first return line 20. Similarly, the second portion travels from flow divider 12 to second motor 40 through second supply line 18. The second portion powers second motor 40, and second motor 40 drives second pump 42. The second portion exits second motor 40 and returns to reservoir 28 through second return line 22. Hydraulic drive 15 drives the hydraulic fluid downstream from reservoir 28, through flow divider 12, to first drive unit 24 and second drive unit 26, and back to reservoir. Hydraulic drive 15 can include a hydraulic pump, for drawing the hydraulic fluid from reservoir 28 and driving the hydraulic fluid downstream through flow divider 12, first drive unit 24 and second drive unit 26, and back to reservoir 28. Hydraulic drive 15 can also include a power source, such as an electric motor or an engine, for powering the hydraulic pump. As such, it is understood that hydraulic drive 15 may have any suitable configuration for driving the hydraulic fluid from reservoir 28, through flow divider 12, first drive unit 24, and second drive unit 26, and back to reservoir 28.

While flow divider 12 is described as providing hydraulic fluid downstream through first supply line 16 and second supply line 18, it is understood that flow divider 12 may be integrally assembled with first motor 36 and second motor 38 such that short passages would direct hydraulic fluid downstream from flow divider 12 to either first motor 36 or second motor 38. Alternatively, flow divider 12, first motor 36, and second motor 40 could be integrated into a single machined block or manifold. As such, flow divider 12 may provide hydraulic fluid to first motor 36 and second motor 40 in suitable manner.

First pump 38 is driven by first motor 36. First pump 38 draws a first component material from first container 52 through first component feed line 44. First pump 38 then drives the first component material downstream through a first component distribution line 46 to the spray gun. Second pump 42 is driven by second motor 40. Second pump 42 draws a second component material from second container 54 through second component feed line 48. Second pump 42 then drives the second component material downstream through second component distribution line 50 to the spray gun. The first component material and the second component material combine at mixing manifold 56 to form a plural component material.

First pump 38 is preferably a piston pump, but it is understood that first pump 38 may be any pump suitable to for providing a component material downstream at a desired pressure. Similar to first pump 38, second pump 42 is preferably a piston pump, but it is understood that second pump 42 may be any pump suitable to for providing a component material downstream at a desired pressure. In addition, first pump 38 and second pump 42 are preferably of equal size and displacement. It is to be understood, however, that pumps of variable size and displacement may be utilized. Where pumps of various size and displacement are utilized, flow divider 12 accounts for the differences to provide flow downstream at a desired ratio. For example, where first pump 38 has twice the displacement of second pump 42 and a 1:1 ratio is desired, a 2:1 flow divider 12 may be utilized to provide twice the hydraulic fluid to second pump 42 as to first pump 38. Providing more hydraulic fluid to second pump 42 accounts for the difference in displacement and achieves a 1:1 ratio, without a user having to change out pumps or use a different system.

Flow divider 12 controls the ratio of hydraulic fluid provided to first motor 36 and second motor 40. The ratio of the hydraulic fluid provided to first motor 36 and second motor 40 controls a ratio of the first component material to the second component material provided to mixing manifold to form the plural component material. Both first pump 38 and second pump 42 provide a component material downstream at a desired pressure, which is set by the user. The flow of hydraulic fluid to first motor 36 and second motor 40 controls the speed of first pump 38 and second pump 42, which controls the ratio of the first component material to the second component material.

For example, where a 2:1 ratio of the first component material to the second component material is desired, a 2:1 flow divider 12 will be used in hydraulic proportioning system 10. Hydraulic drive 15 drives hydraulic fluid from reservoir 28 to flow divider 12 through inlet line 14. The hydraulic fluid enters flow divider 12 through inlet line 14. Flow divider 12 splits the flow of hydraulic fluid into a first portion and a second portion in a known manner. The first portion exits flow divider 12 through first outlet 32 and flows downstream through first supply line 16. The second portion exits flow divider 12 through second outlet 34, and flows downstream through second supply line 18. The first portion is provided to first motor 36 to drive first pump 38. The second portion is provided to second motor 40 to drive second pump 42. Because flow divider 12 is a 2:1 flow divider, the first portion will be twice that of the second portion.

As discussed above, first pump 40 drives the first component material at the same pressure that second pump 42 drives the second component material. As such, the greater volume of hydraulic fluid provided to first motor 36 causes first motor 36 to drive first pump 38 at twice the speed at which second motor 40 drives second pump 42. This causes first pump 38 to provide twice the volume of the first component material downstream through first component distribution line 46 as compared to the volume of second component material that second pump 42 provides downstream through second component distribution line 50. In this way, a 2:1 ratio is maintained between the first component material and the second component material to ensure that the plural component material has desirable properties. It is understood, however, that hydraulic proportioning system 10 may utilize any suitable flow divider to achieve the desired downstream ratio of the first component material to the second component material.

Similarly, a 2:1 ratio of the second component material to the first component material is easily achieved by changing the supply line connection at hydraulic divider 12. In this instance, the first supply line 16 would connect to second outlet 34 and second supply line 18 would connect to first outlet 32. In this way, twice the flow of hydraulic fluid would be provided to second motor 40 to drive second pump 42 that the flow provided to first motor 36 to drive first pump 38. As discussed above, the flow of hydraulic fluid controls the speed of first pump 38 and second pump 42. However, first pump 38 and second pump 42 drive the component materials at the same pressure. While a 2:1 flow divider has been described, it is understood that hydraulic proportioning system 10 may utilize a flow divider configured to provide any desired ratio, preferably about 1:1 to about 4:1.

While hydraulic proportioning system 10 is described as including flow divider 12 that divides a flow of hydraulic fluid into two portions, it is understood that hydraulic proportioning system 10 may divide a flow of hydraulic fluid into as many portions as is desirable. For example, where a plural component material has three component parts, with a desired 1:1:1 ratio, flow divider 12 may include three outlets for supplying hydraulic fluid to three drive units. Thus, while hydraulic proportioning system 10 is described as including two pumps, it is understood hydraulic proportioning system 10 may include as many pumps as are needed, such as three for a 1:1:1 ratio, to provide component materials downstream to form the plural component material. Alternatively, for the same three-part plural component material, hydraulic proportioning system 10 may include a 2:1 flow divider operating in series with a 1:1 flow divider. To achieve the 1:1:1 ratio, the 2:1 flow divider would divide an incoming flow into a first portion and a second portion, with the first portion having twice the volume of the second portion. The 1:1 flow divider would then be positioned to receive the first portion, which the 1:1 flow divider would divide into two equal portions. The two equal portions would thus have the same volume as the second portion, thus providing a 1:1:1 flow ratio.

Figure 2A:
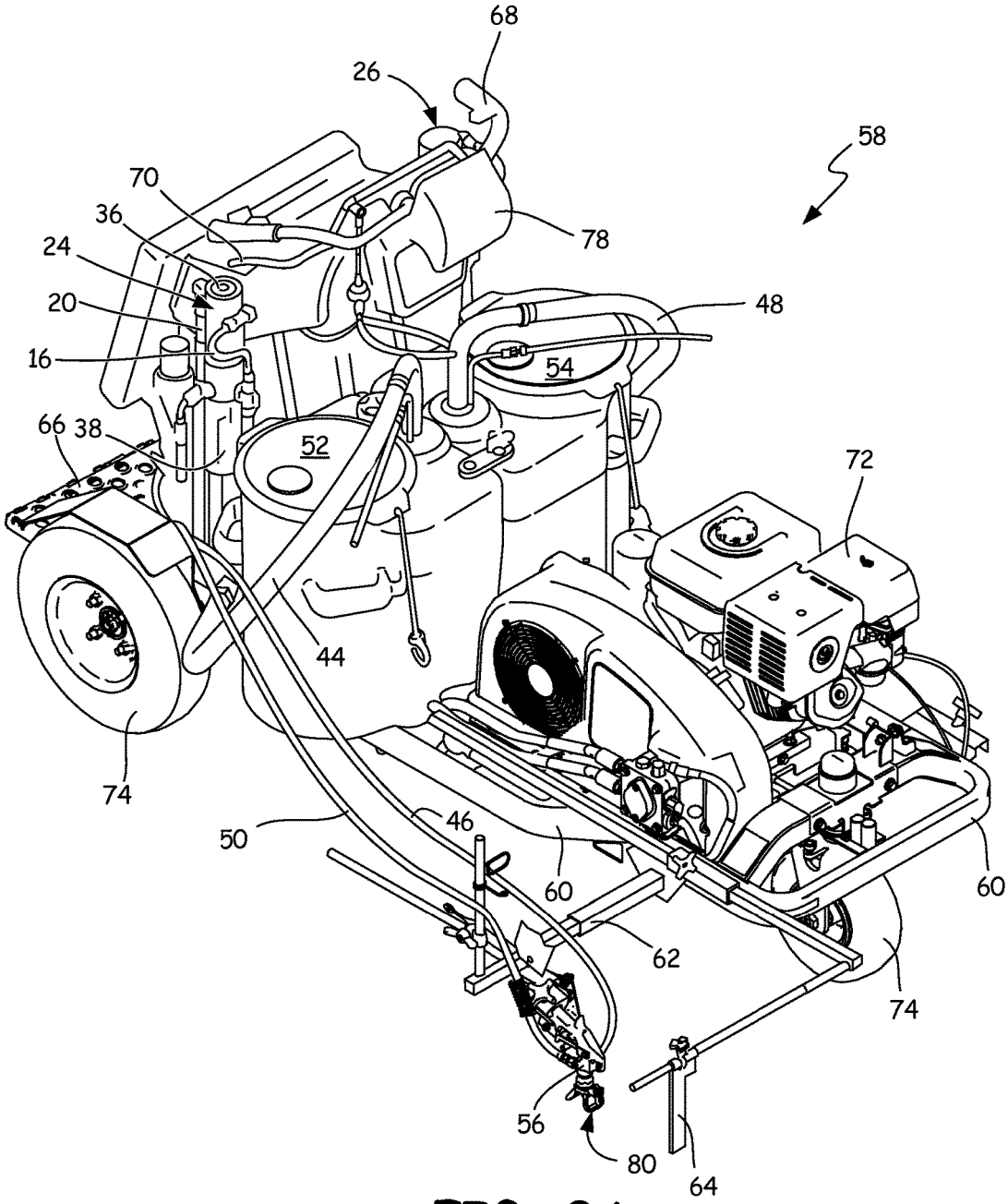
FIG. 2A is a perspective view of a mobile applicator with a hydraulic proportioning system.
Figure 2B:
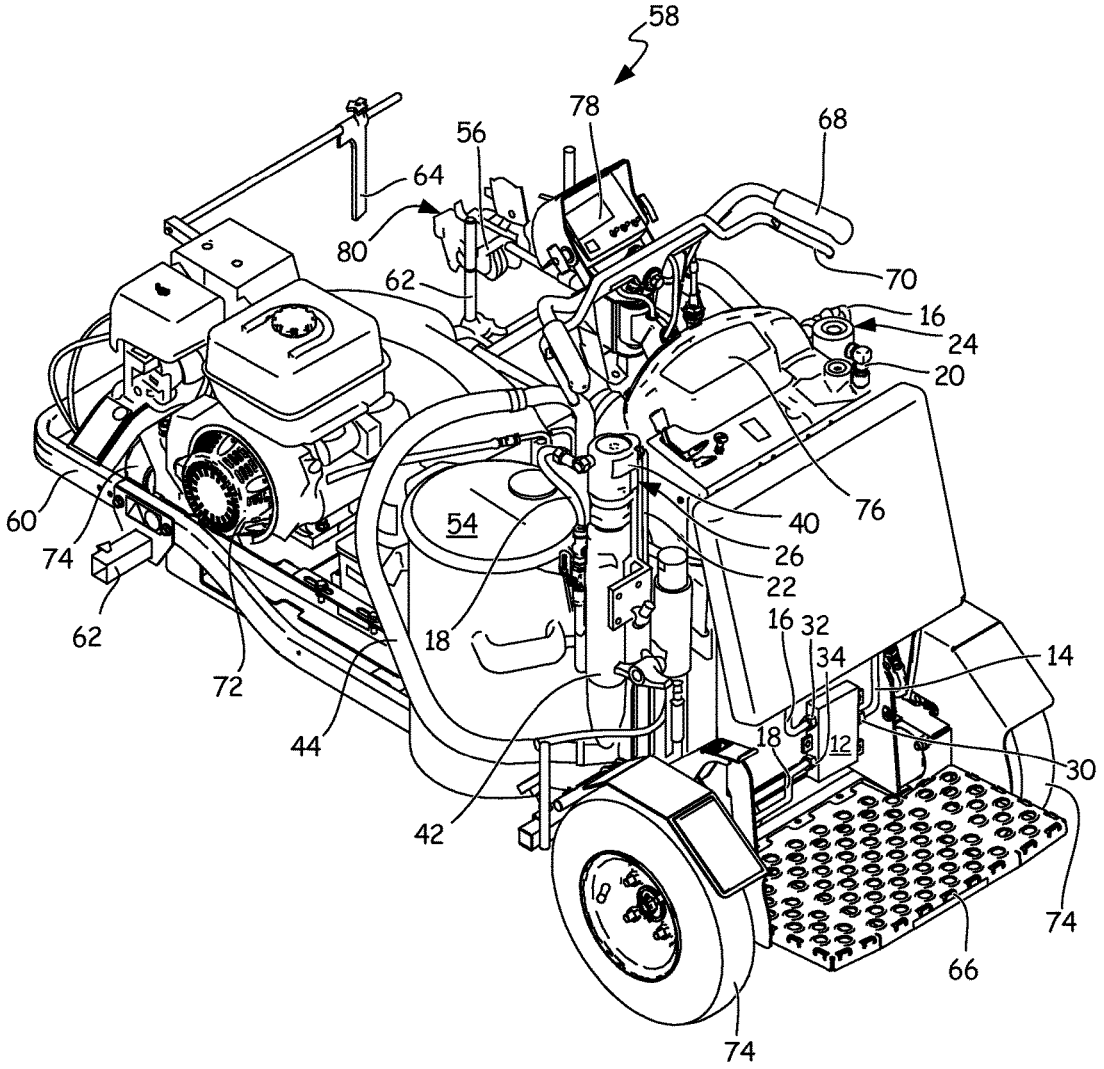
FIG. 2B is a rear perspective view of a mobile applicator with a hydraulic proportioning system.

FIG. 2A is a front perspective view of mobile applicator 58 with hydraulic proportioning system 10. FIG. 2B is a rear perspective view of mobile applicator 58 with hydraulic proportioning system 10. FIGS. 2A and 2B will be discussed together. Mobile applicator 58 includes frame 60, first container 52, second container 54, mixing manifold 56, gun mount 62, alignment device 64, platform 66, handlebar 68, control lever 70, applicator motor 72, wheels 74, control panel 76, display 78, and spray gun 80. Hydraulic proportioning system 10 includes flow divider 12, inlet line 14, hydraulic drive 15 (shown in FIG. 1), first supply line 16, second supply line 18, first return line 20, second return line 22, first drive unit 24, second drive unit 26, reservoir 28 (shown in FIG. 1), first component feed line 44, first component distribution line 46, second component feed line 48, and second component distribution line 50. Flow divider 12 includes inlet 30, first outlet 32, and second outlet 34. First drive unit 24 includes first motor 36 and first pump 38. Second drive unit 26 includes second motor 40 and second pump 42.

Mobile applicator 58 is utilized to mark pavement lines on a pavement surface by combining one component material with another component material and applying the resulting plural component material to the pavement surface. Frame 60 supports mobile applicator 58 and various other components of mobile applicator 58. Frame 60 may be made of any suitable supporting material, including aluminum, steel, or both. First container 52 and second container 54 are mounted to a top of frame 60. First container 52 receives and stores one component material and second container 54 receives and stores another component material. It is understood that first container 52, second container 54, or both may be heated in any suitable manner, such as with burners, to prepare either component material for combination with the other component material.

Wheels 74 are rotatably attached to the bottom of frame 60. In the illustrated embodiment, mobile applicator 58 includes three wheels 74: one front wheel, which swivels to provide directional control, and two rear wheels which track behind the front wheel. Platform 66 is disposed at a rear of frame 60 between the two rear wheels. Platform 66 supports a user during operation of mobile applicator 58. Platform 66 may also be pivoted on hinges to a vertical storage position. Applicator motor 72 is mounted to frame 60, and applicator motor 72 provides motive force to mobile applicator 58 such that mobile applicator is self-propelled. Handlebar 68 is disposed at a rear of mobile applicator 58 and allows the user to steer mobile applicator 58. Control lever 70 is mounted below and in close proximity to handlebar 68. The user manipulates control lever 70 to move mobile applicator 58 in forward or reverse. Control panel 76 is mounted in front of handlebars and allows the user to control engine speed, outlet pressure, and various other aspects of mobile applicator 58. Display 78 is mounted to handlebars 70 and allows the user to control various aspects of mobile applicator 58, such as the configuration of the line being laid down, either solid line or broken line. Display 78 also provides the user with other information regarding mobile applicator 58. While mobile applicator 58 has been described as a self-propelled applicator, it is understood that mobile applicator 58 may be propelled by the user or in any other suitable manner. One skilled in the art will appreciate that although directional terms such as "forward," "aft," "bottom," "top," "right side," and "left side" have been used, such terms are merely relational descriptors of the illustrated embodiments shown herein.

Gun mount 62 is removably attached to and projects from frame 52. In the illustrated embodiment, gun mount 62 is attached to a forward, right hand side of frame 52, but it is understood that gun mount 62 may be attached at any suitable portion of frame 52 that allows mobile applicator 58 to lay down pavement markings without interfering with the marking process. Spray gun 80 is mounted to gun mount 62. Spray gun 80 includes mixing manifold 56 that receives the first component material from first component distribution line 46 and the second component material from second component distribution line 50. The first component material and the second component material mix together in mixing manifold 56 to form the plural component material before application through spray gun 80. Alignment device 64 is mounted forward of and aligned with spray gun 80. Alignment device 64 provides a visual indication of the path on which spray gun 80 is aligned.

Hydraulic proportioning system 10 is mounted to mobile applicator 58. Flow divider 12 is mounted to an aft portion of frame 60 between platform 66 and handlebar 68, as shown in FIG. 2B. First drive unit 24 is mounted to an aft, right-hand side of frame 60. First motor 36 is connected to and drives first pump 38. Second drive unit 26 is mounted to an aft, left-hand side of frame 60. Second motor 40 is connected to and drives second pump 42. Inlet line 14 fluidly connects flow divider 12 and reservoir 28 (shown in FIG. 1). Hydraulic divider 15 is disposed between flow divider 12 and reservoir 28. First supply line 16 is connected to first outlet 32 of flow divider 12 and to first motor 36 and first supply line 16 provides a fluid path for hydraulic fluid from flow divider 12 to power first motor 36. First return line 20 is connected to first motor 36 and to reservoir 28, and first return line 20 provides a fluid path for hydraulic fluid exiting first motor 36 to return to reservoir 28. Second supply line 18 is connected to second outlet 34 of flow divider 12 and to second motor 40. Second supply line 18 provides hydraulic fluid to power second motor 40. Second return line 22 is connected to second motor 40 and to reservoir 28, and second return line 22 provides a return path to reservoir 28 for hydraulic fluid exiting second motor 40.

First component feed line 44 is connected to first container 52 and to an inlet of first pump 38. First component distribution line 46 is connected to first pump 38 and to mixing manifold 56. Second component feed line 48 is connected to second container 54 and to an inlet of second pump 42. Second component distribution line 50 is connected to second pump 42 and to mixing manifold 56.

Hydraulic proportioning system 10 is mounted to mobile applicator 58 to accurately proportion a first component material from first container 52 and a second component material from second container 54 for combination in mixing manifold 56. A plural component material is formed by the combination of the component materials, and the plural component material is applied to a surface, such as a pavement surface. The user selects the plural component material for application to the pavement surface, and the user loads a first component material into first container 52 and a second component material into second container 54. When the hydraulic system is activated, hydraulic drive 15 draws hydraulic fluid from reservoir 28 and drives the hydraulic fluid downstream through flow divider 12. Flow divider 12 receives the hydraulic fluid through inlet line 14 and separates the flow of hydraulic fluid into two portions. The first portion exits flow divider 12 through first outlet 32 and is provided downstream through first supply line 16 to first motor 36, and first motor 36 powers first pump 38. The second portion exits flow divider 12 though second outlet 34 and is provided downstream through second supply line 18 to second motor 40, and second motor 40 powers second pump 42. As discussed above, hydraulic proportioning system 10 is capable of providing any desired ratio of the first component material to the second component material by simply swapping flow divider 12 with a flow divider configured to provide the desired flow ratio. In this way, mobile applicator 58 is capable of applying any plural component material regardless of the required ratio because hydraulic proportioning system 10 is capable of providing the first component material and the second component material at any desired ratio.

First pump 38 draws the first component material from first container 52 through first component feed line 44. First pump 38 drives the first component material downstream through first component distribution line 46 and to mixing manifold 56. Second pump 42 draws the second component material from second container 54 through second component feed line 48. Second pump 42 drives the second component material downstream through second component distribution line 50 and to mixing manifold 56. The first component material and the second component material are combined in mixing manifold 56 to form the plural component material. The plural component material is applied to the pavement surface by spraying the plural component material through spray gun 80.

Flow divider 12 allows the user to provide component materials downstream at any desired ratio. Flow divider 12 also allows the user to account for variations in viscosity, particle size, and other material properties. For example, the user may desire a 2:1 ratio between a first component material and a second component material, where the first component material has a greater viscosity than the second component material. A flow divider 12 having a ratio greater than 2:1, such as 2.3:1, 2.4:1, or any other desired ratio depending on the actual properties of the first component material and the second component material, is installed in hydraulic proportioning system 10. The greater flow of hydraulic fluid to first motor 36 will drive first pump 38 at a greater speed to account for the difference in viscosity between the first component material and the second component material. In this way, hydraulic proportioning system 10 will provide the component materials downstream at the desired 2:1 ratio while accounting for variations in material properties.

Hydraulic proportioning system 10 allows for a multitude of mounting configurations, which allows smaller and more compact platforms to be utilized for plural component material application. In the currently illustrated embodiment, flow divider 12 is shown as mounted to an aft portion of frame 60. However, flow divider 12 may be mounted at any desired location on mobile applicator 58. Flow divider 12 is connected to first drive unit 24, second drive unit 26, and reservoir 28 by flexible tubing, such as inlet line 14, first supply line 16, and second supply line 18. Hydraulic drive 15 drives hydraulic fluid downstream from reservoir 28 through the flexible tubing. Hydraulic drive 15 may be placed at any suitable position on mobile applicator 58 such that hydraulic drive 15 draws hydraulic fluid from reservoir 28 and drives the hydraulic fluid downstream. The flexible tubing can be configured such that the various components of hydraulic proportioning system 10 are capable of being mounted at any available location. Similarly, first drive unit 24 is connected to flow divider 12, first container 52, and mixing manifold 56 by flexible tubing. This enables first drive unit 24 to be placed at any desired location on mobile applicator 58, without affecting the function of first drive unit 24. Second drive unit 26 is connected to flow divider 12, second container 54, and mixing manifold 56 by a series of flexible tubing. This configuration similarly allows second drive unit 26 to be placed at any desired location on mobile applicator 58. As previously discussed, it is understood that flow divider 12 can be integrally formed with first motor 36 and second motor 38, such that there is no flexible tubing disposed between either flow divider 12 and first motor 36 or flow divider 12 and second motor 38. Thus, hydraulic proportioning system 10 allows for a multitude of space-saving configurations, which allows hydraulic proportioning system 10 to be easily configured to fit existing mobile applicators.

Figure 3:
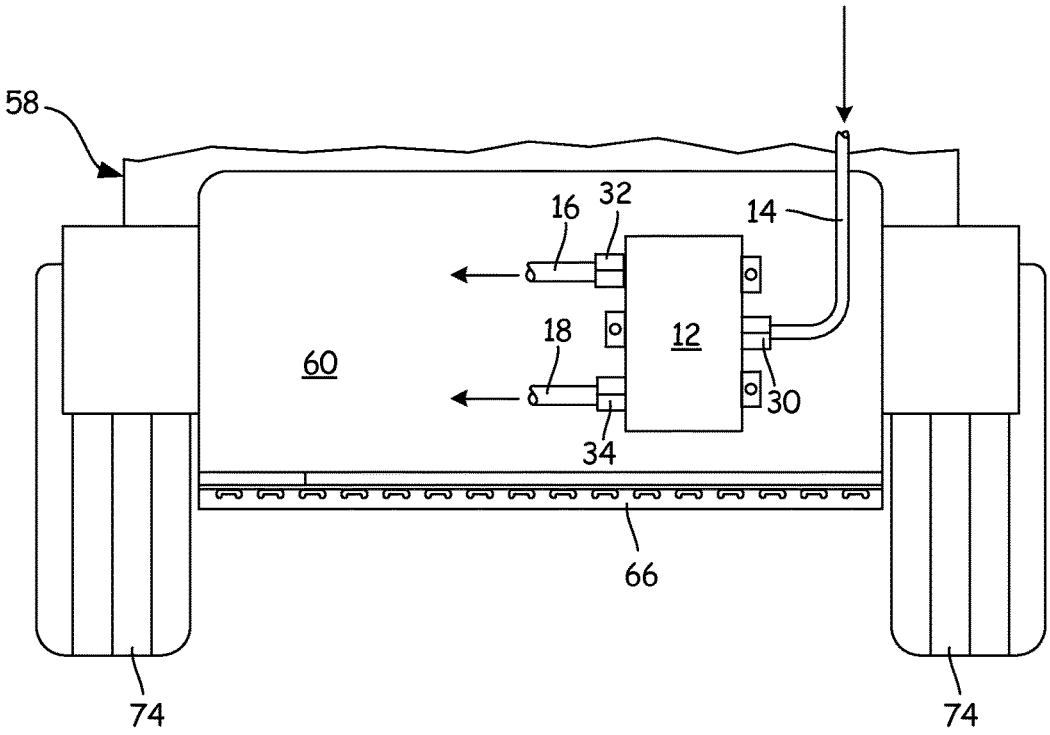
FIG. 3 is a rear view of a mobile applicator showing a flow divider of the hydraulic proportioning system.

FIG. 3 is a rear view of mobile applicator 58 and flow divider 12 of hydraulic proportioning system 10. FIG. 3 depicts frame 60, platform 66, and wheels 74 of mobile applicator 58, and depicts flow divider 12, inlet line 14, first feed line 16, and second feed line 18 of hydraulic proportioning system 10. Flow divider 12 includes inlet 30, first outlet 32, and second outlet 34.

Wheels 74 are rotatably supported by frame 60. Platform 66 is connected to frame 60, and platform 66 allows the user to ride mobile applicator 58 during application of the plural component material. Flow divider 12 is mounted to frame 52. Inlet line 14 is connected to inlet 30 of flow divider 12. First supply line 16 is connected to first outlet 32 and second supply line 18 is connected to second outlet 34.

Flow divider 12 separates a flow of hydraulic fluid into a plurality of portions to power hydraulic motors. Flow divider 12 draws hydraulic fluid from reservoir 28 (shown in FIG. 1) through inlet line 14. Flow divider 12 then separates the hydraulic fluid into separate portions which are provided downstream to power hydraulic motors. In the illustrated embodiment, the flow of hydraulic fluid is divided into a first portion and a second portion. The first portion exits flow divider 12 through first outlet 32 and the first portion is provided downstream through first supply line 16 to power first motor 36 (best seen in FIG. 2A). The second portion exits flow divider 12 through second outlet 34, and the second portion is provided downstream through second supply line 18 to power second motor 40 (best seen in FIG. 2B).

Flow divider 12 is preferably a rotary gear flow divider, which utilizes gear sections connected on a common shaft to divide the flow according to a pre-set ratio. In such a divider, the gear ratio determines the ratio between the portions of hydraulic fluid exiting the flow divider. Rotary gear flow dividers have very small efficiency losses and have little to no lag-time, which ensures that the desired ratio is maintained. While a rotary gear flow divider has been described, it is understood that any suitable flow divider may be used, such as a spool type flow divider. It is understood that hydraulic proportioning system 10 may utilize a flow divider configured to provide any desired ratio, preferably ratios of about 1:1 to about 4:1.

Figure 4:
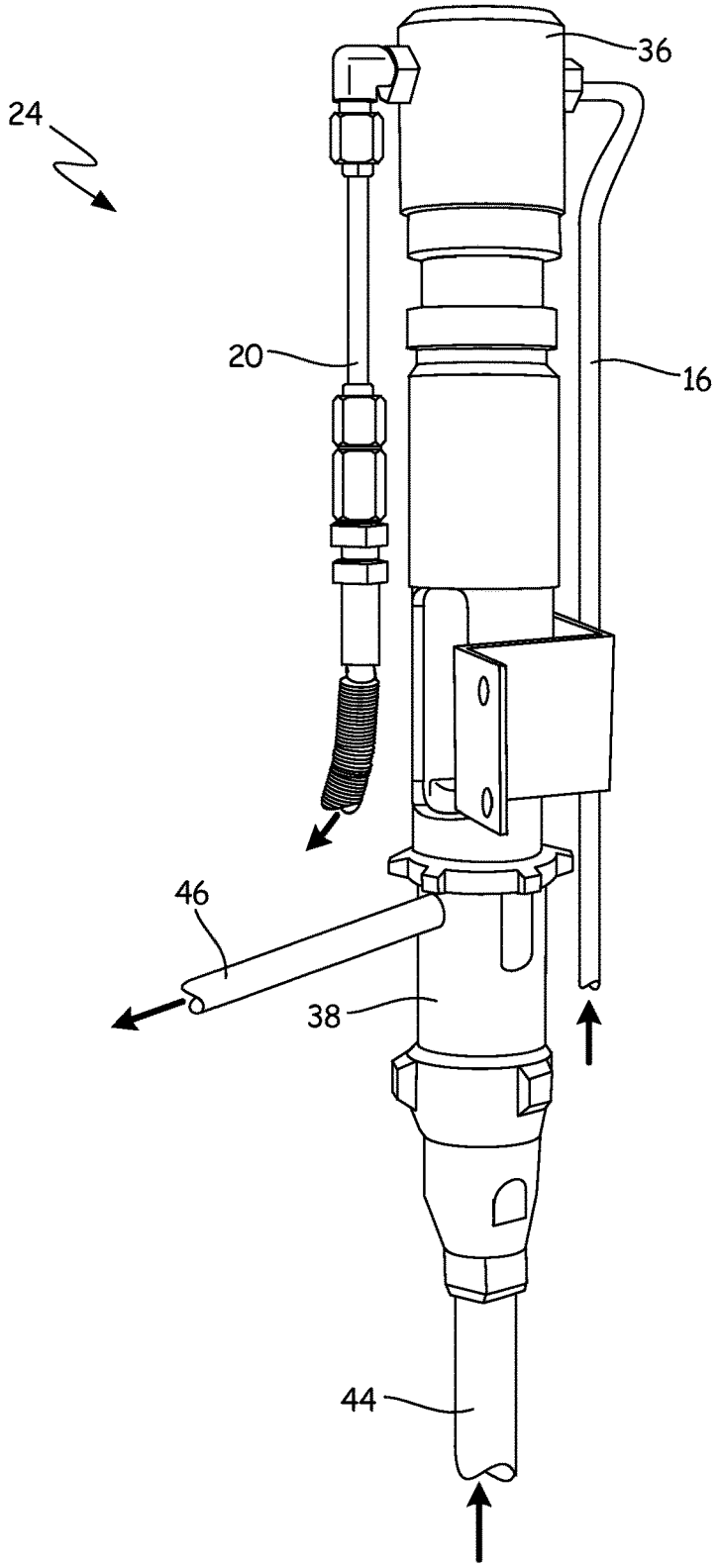
FIG. 4 is a perspective view of a pump of the hydraulic proportioning system.

FIG. 4 is a perspective view of first drive unit 24 of hydraulic proportioning system 10. First drive unit 24 includes first motor 36, first pump 38, first supply line 16, first return line 20, first component feed line 44, and first component distribution line 46.

First container 52 (best seen in FIG. 2A) holds a first component material until the first component material is to be pumped downstream and combined with a second component material to form a plural component material for application to a pavement surface. First motor 36 is mounted to and drives first pump 38. First supply line 16 is connected to first motor 36 and to flow divider 12 (best seen in FIG. 3). First return line is connected to first motor 36 and to reservoir 28 (shown in FIG. 1). First component feed line 44 is connected to first container 52 and to first pump 38. First component distribution line 46 is connected to first pump 38 and to mixing manifold 56 (best seen in FIG. 2A).

First feed line 16 provides hydraulic fluid to first motor 36 from flow divider 12 to power first motor 36. Spent hydraulic fluid is returned to reservoir 28 from first motor 36 through first return line 20. First motor 36 drives first pump 38 to convey the first component material from first container 52 downstream to mixing manifold 56. First pump 38 draws the first component material from first container 52 through first component feed line 44. First pump 38 then drives the first component material downstream through first component distribution line 46 and to mixing manifold 56, where the first component material is mixed with a second component material to form a plural component material for application to the pavement surface.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A hydraulic proportioning system comprising:

a flow divider, the flow divider configured to receive a flow of hydraulic fluid and divide the flow of hydraulic fluid into a first portion and a second portion, wherein the first portion and the second portion exit the flow divider at a set hydraulic fluid ratio;

a first motor fluidly connected to the flow divider to receive the first portion from the flow divider, wherein the first portion powers the first motor;

a second motor fluidly connected to the flow divider to receive the second portion from the flow divider, wherein the second portion powers the second motor;

a first pump driven by the first motor, wherein the first pump drives a first component material downstream; and a second pump driven by the second motor, wherein the second pump drives a second component material downstream;

wherein the first pump and the second pump are configured to provide the first component material and the second component material at a component ratio, the component ratio based on the set hydraulic fluid ratio.

2. The hydraulic proportioning system of claim 1, wherein the flow divider is a rotary gear flow divider.

3. The hydraulic proportioning system of claim 1, wherein the first pump is a piston pump and wherein the second pump is a piston pump.

4. The hydraulic proportioning system of claim 1, wherein the set hydraulic fluid ratio is between about 1:1 and about 4:1.

5. The hydraulic proportioning system of claim 4, wherein a displacement of the first pump is equal to a displacement of the second pump.

6. The hydraulic proportioning system of claim 1, and further comprising:

a mixing manifold;

a first material line connecting the first pump to the mixing manifold; and a second material line connecting the second pump to the mixing manifold;

wherein the first pump provides the first component material to the mixing manifold and the second pump provides the second component material to the mixing manifold.

7. The hydraulic proportioning system of claim 6, wherein the component ratio at the mixing manifold is between about 1:1 and about 4:1.

8. A mobile applicator comprising:

a frame;

a plurality of wheels rotatably connected to the frame;

a first container mounted on the frame;

a second container mounted on the frame;

a mixing manifold positioned to receive a first component material from the first container and a second component material from the second container; and a plural component proportioning system comprising:

a flow divider, the flow divider configured to receive a flow of hydraulic fluid and divide the flow of hydraulic fluid into a first portion and a second portion, wherein the first portion and the second portion exit the flow divider at a set hydraulic fluid ratio;

a first motor fluidly connected to the flow divider by a first hydraulic line extending between the flow divider and the first motor, the first hydraulic line configured to supply the first portion to the first motor, the first portion configured to drive the first motor;

a second motor fluidly connected to the flow divider by a second hydraulic line extending between the flow divider and the second motor, the second hydraulic line configured to supply the second portion to the second motor, the second portion configured to drive the second motor;

a first pump configured to be driven by the first motor and to drive the first component material from the first container to the mixing manifold; and a second pump configured to be driven by the second motor and to drive the second component material from the second container to the mixing manifold;

wherein the first pump and the second pump are configured to provide the first component material and the second component material to the mixing manifold at a component ratio, the component ratio based on the hydraulic fluid ratio.

9. The mobile applicator of claim 8, wherein the flow divider is a rotary gear flow divider.

10. The mobile applicator of claim 8, wherein the first pump is a piston pump and wherein the second pump is a piston pump.

11. The mobile applicator of claim 8, wherein the set hydraulic fluid ratio is between about 1:1 and about 4:1.

12. The mobile applicator of claim 11, wherein a displacement of the first pump is equal to a displacement of the second pump.

13. The mobile applicator of claim 12, wherein the component ratio at the mixing manifold is between about 1:1 and about 4:1.

14. The mobile applicator of claim 8, and further comprising:

a third hydraulic motor mounted to the frame;

a third hydraulic line connecting the third hydraulic motor to the flow divider; and a third pump driven by the third hydraulic motor.

15. The mobile applicator of claim 8, and further comprising:

an applicator motor, wherein the applicator motor propels the mobile applicator.

16. A method for proportioning plural component materials comprising:

dividing, with a flow divider, a flow of hydraulic fluid into a first portion and a second portion according to a set hydraulic fluid ratio;

providing the first portion to a first hydraulic line extending between the flow divider and a first hydraulic motor and the second portion to a second hydraulic line extending between the flow divider and a second hydraulic motor;

powering the first hydraulic motor with the first portion of the hydraulic fluid and powering the second hydraulic motor with the second portion of the hydraulic fluid;

driving a first hydraulic pump at a first speed with the first hydraulic motor, the first hydraulic pump driving a first component material;

driving a second hydraulic pump at a second speed with the second hydraulic motor, the second hydraulic pump driving a second component material;

mixing the first component material with the second component material in a mixing manifold; and controlling a ratio of the first component material to the second component material at the mixing manifold based upon the set hydraulic fluid ratio.

17. The method of claim 16 wherein the flow divider is a rotary gear divider.

18. The method of claim 16, wherein the first hydraulic pump is a piston pump and the second hydraulic pump is a piston pump.

19. The method of claim 16, wherein the ratio of the first material to the second material at the mixing manifold is between about 1:1 and about 4:1.

20. The method of claim 16, wherein a ratio of the first portion to the second portion is between about 1:1 and about 4:1.

* * * * *